US007296544B2

(12) United States Patent
Deeke

(10) Patent No.: US 7,296,544 B2
(45) Date of Patent: Nov. 20, 2007

(54) INTERNAL COMBUSTION ENGINE

(76) Inventor: Georg Wilhelm Deeke, 20 Old Parr Road, Banbury, Oxfordshire, OX16 5HT (GB)

( * ) Notice: Subject to any disclaimer, the term of this patent is extended or adjusted under 35 U.S.C. 154(b) by 0 days.

(21) Appl. No.: 10/451,013

(22) PCT Filed: Dec. 18, 2001

(86) PCT No.: PCT/GB01/05621

§ 371 (c)(1),
(2), (4) Date: Sep. 8, 2003

(87) PCT Pub. No.: WO02/50410

PCT Pub. Date: Jun. 27, 2002

(65) Prior Publication Data

US 2004/0045516 A1 Mar. 11, 2004

(30) Foreign Application Priority Data

Dec. 21, 2000 (GB) ..... 0031187.8

(51) Int. Cl.
*F02B 75/16* (2006.01)

(52) U.S. Cl. ..... 123/63

(58) Field of Classification Search ..... 123/63, 123/61 V, 62, 61 R
See application file for complete search history.

(56) References Cited

U.S. PATENT DOCUMENTS 2,317,167 A * 4/1943 Baer ..... 123/63
3,710,767 A * 1/1973 Smith ..... 123/63
4,932,373 A * 6/1990 Carson ..... 123/197.4
5,771,849 A * 6/1998 Hamy ..... 123/73 R

FOREIGN PATENT DOCUMENTS

EP 861976 A2 * 9/1998
GB 145209 A * 7/1920

* cited by examiner

*Primary Examiner*—Stephen K. Cronin
*Assistant Examiner*—Hyder Ali
(74) *Attorney, Agent, or Firm*—Paul E. Milliken; Ray L. Weber

(57) ABSTRACT

A four stroke internal combustion engine (110) having at least one cylinder (13) having a double acting piston (16) dividing the cylinder into two combustion chambers (14 & 15) and being reciprocable within the cylinder (13) to perform a power stroke producing work on a crankshaft (21) whilst moving towards or away from the crankshaft. The piston (16) has a pivotal connection (30) with a connecting rod (17) in turn connected directly to the crankshaft (21). A separation plate (18) separates the engine sump (12) from the adjacent combustion chamber (15) and accommodates lateral movement of the connecting rod (17) passing sealingly therethrough.

13 Claims, 3 Drawing Sheets

INTERNAL COMBUSTION ENGINE

FIELD

This invention relates to internal combustion engines and in particular to four stroke engines sometimes referred to as Otto engines.

BACKGROUND OF THE INVENTION

A conventional Otto engine operates in four strokes a) Induction stroke in which the piston moves towards the crankshaft and sucks a mixture of fuel and air into the cylinder through an open inlet valve or valves b) Compression stroke in which the inlet valve(s) close(s) and the mixture is compressed as the piston moves away from the crankshaft, then ignition of the combustible gases followed by c) the power stroke as the piston is pushed down by the expanding gases preforming work, and d) the exhaust stroke as the piston moves away from the crank shaft and the exhaust valve or valves are opened so that the burnt mixture is pushed out of the cylinder. The cylinder is now ready for the next cycle.

Many different arrangements of cylinders around a single crank shaft have been proposed. The most conventional engines have multiple pistons arranged in various configurations e.g. in line, in V formation, horizontally opposed to each other, and radially.

In more recent times the moving parts of engines have become lighter which reduces problems due to lack of balance and has allowed the development of high speed (r.p.m.) engines.

For example in U.S. Pat. No. 3,710,767, DE 3921 581 there is disclosed four stroke internal combustion engines which have double acting pistons. By "double acting" is meant pistons performing a power stroke in either direction of movement of the piston. The different engines disclosed have a disadvantage in that their pistons are rigidly fixed to a coaxial piston rod which in turn is connected to the crankshaft through a conventional connecting rod. This produces a larger heavier engine which have more large moving parts and extended sumps.

The present invention seeks to produce internal combustion engines having better power to weight ratio.

STATEMENTS OF INVENTION

According to the present invention there is provided a four stroke internal combustion engine having at least one cylinder having a double acting piston dividing the cylinder into two combustion chambers and being reciprocable within the cylinder to perform a power stroke producing work on a crankshaft whilst moving towards or away from the crankshaft, the piston being pivotally connected directly to a connecting rod in turn connected directly to the crankshaft.

The piston being connected directly to the crankshaft in the conventional manner allows the use of smaller sumps.

Preferably the connecting rod passes sealingly through a separation plate separating the engine sump from the adjacent combustion chamber, the separation plate accommodating lateral movement of the connecting rod.

In some cases the separation plate may move transversely or radially relative to the cylinder to accommodate associated lateral movement of the connecting rod as the piston reciprocates, or alternatively the separation plate may include a slide member that sealingly slides substantially transversely and/or radially of the cylinder axis.

In an alternative embodiment, said one chamber may include a sealed portion of the crankshaft housing which in a multi-cylinder. engines is sealed from the sealed portions associated with other respective cylinders.

During the operational cycle of the engine, one of said chambers is one step in advance of the other chamber.

Also according to the invention there is provided an internal combustion engine having at least one cylinder with a piston connected directly to a crankshaft by a connecting rod, the piston dividing the cylinder into two combustion chambers so that for each direction of movement the piston can compress an explosive mixture in one of said chambers either side of the piston and one of said chambers includes a sealed portion of the crankshaft housing.

The above inventions are applicable to all forms of internal combustion Otto cycle/four stroke engine including petrol, diesel, kerosene, hydrocarbon gases or liquids, alcohol and hyrodrogen.

DESCRIPTION OF THE DRAWINGS

The invention will be described by way of example and with reference to the accompanying drawings in which.

Detailed Description of the Invention

Figure 1:
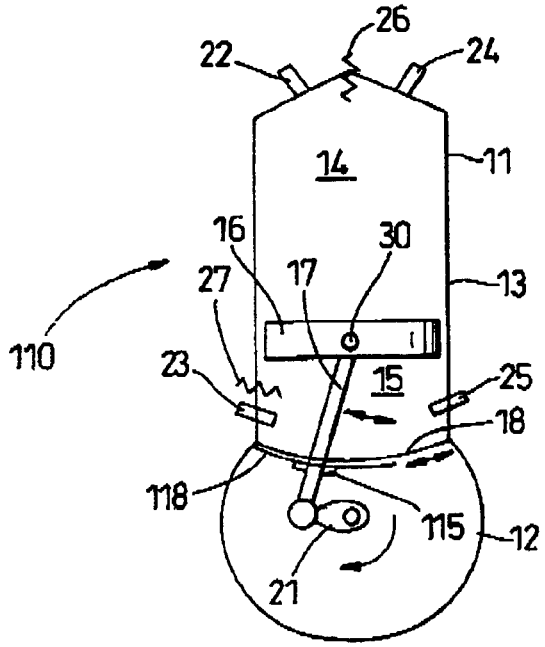
FIG. 1 is a schematic drawing of a cylinder in a first engine configuration according to the present invention.

With reference to FIG. 1 there is shown an internal combustion engine 110 according to the present invention and which is a four stroke engine operable on all conventional fuels e.g petrol, alcohol, fuel oil, hyrocarbon gases, hydrogen etc. The engine 110 comprises a cylinder block 11 mounted on a sump 12. For the sake of convenience only a single cylinder 13 is shown but the block 11 could house any number of cylinders as is desired for a particular engine configuration.

The cylinder 13 is divided into two combustion chambers 14 & 15 by a reciprocable piston 16. The piston 16 is a double acting piston and is directly connected to a connecting rod 17 which sealingly passes through a separation plate 18 which separates the chamber 15 from the sump 12.

The term "double acting" means that a power stroke for the engine can be performed in either direction of movement of the piston.

The piston 16 is connected via a pin 30 to the connecting rod 17 which in turn connected directly to the crank shaft 21 in the conventional manner. The lower combustion chamber 15 is separated from the sump 12 by a separation plate 18 which includes an aperture 113 (see FIG. 4*a*) to accommodate lateral movement of the rod 17. The aperture is closed by a slide portion 118 which can move radially and/or transversely of separation plate 18 and is sealed thereto. The rod 17 will also move vertically in the slide portion 118 and is sealed therein by seals 115 to accommodate such movement.

The two chambers 14 and 15 on each side of the piston 16 are each provided with respective inlet valves 22 23, exhaust valves 24,25 and spark plugs 26,27.

The engine 110 in this example is an Otto cycle engine which utilizes a single piston 16 to produce a power stroke in both directions of movement of the piston (i.e towards and away from the crankshaft), which will hereinafter be called a double stroke cycle.

One operational cycle of the two chamber 14 & 15 will be explained with reference to FIG. 2:

Step 1: has the lower chamber 15 in the compression stroke with the upper chamber 14 in the induction stroke.

Step 2: has the lower chamber 15 in the power stroke and the upper chamber 14 in the compression stroke.

Step 3: has the lower chamber 15 in the exhaust stroke and the upper chamber 14 in the power stroke, and Step 4: has the lower chamber 15 in the induction stroke and the upper chamber 14 in the exhaust stroke .

The cycle then begins again at step 1.

In essence at any stage in the cycle, the stroke in the lower chamber 15 is repeated in the upper chamber 14 during the next consecutive stroke.

An alternative operational cycle of the two chambers will be explained with reference to FIG. 3:

Step 1 has the lower chamber 15 in the compression stroke with the upper chamber in the power stroke.

Step 2 has the lower chamber 15 in the power stroke with the upper chamber in the exhaust stroke.

Step 3 has the lower chamber in the exhaust stroke with the upper chamber 14 in the induction stroke.

Step 4 has the lower chamber 15 in the induction stroke with the upper chamber in the compression stroke.

The cycle then begins again at step 1. In essence at any stage in the cycle the stroke in the lower chamber 15 is one step, behind the stroke in the upper chamber.

Figure 2:
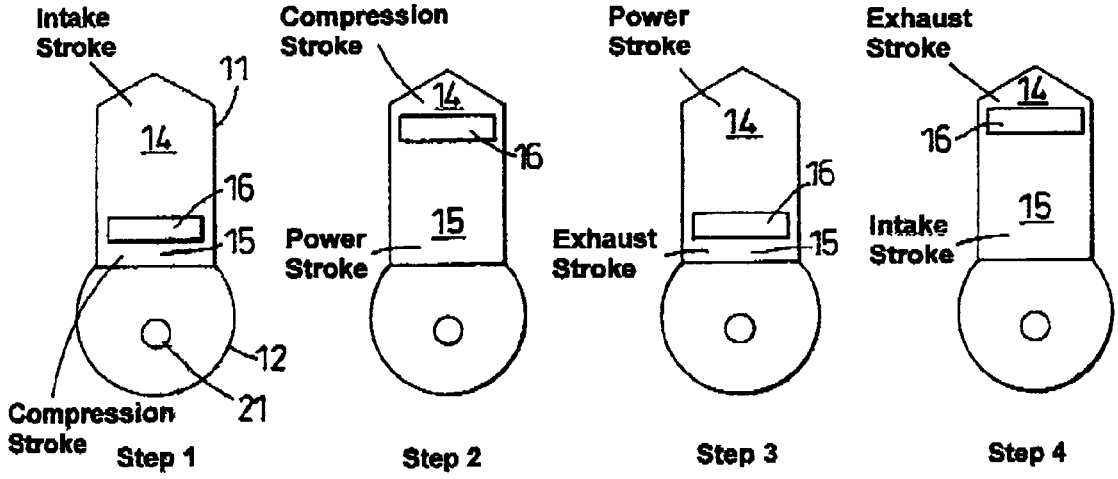
FIG. 2 is a schematic representation of the operational cycle of a cylinder shown in any one of FIGS. 1, 4, & 5.
Figure 3:
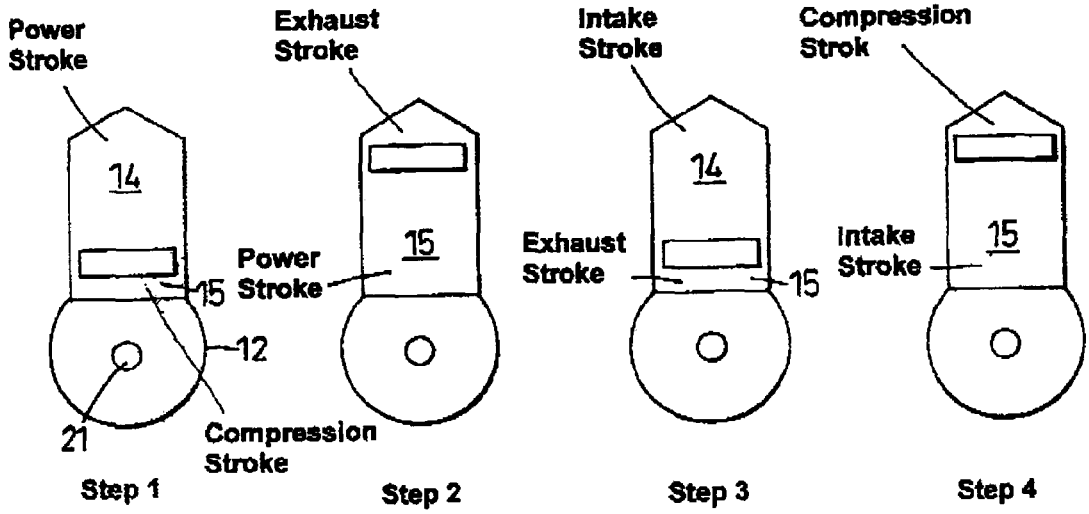
FIG. 3 is a schematic representation of an alternative operational cycle of a cylinder shown in any one of FIGS. 1, 4, and 5.

Any number of cylinders can be incorporated in an engine system, each cylinder using one of the operational cycles shown in FIGS. 2 or 3, and in some engine systems some cylinders may operate on one cycle while other cylinders operate simultaneously on the other cycle.

Figure 4:
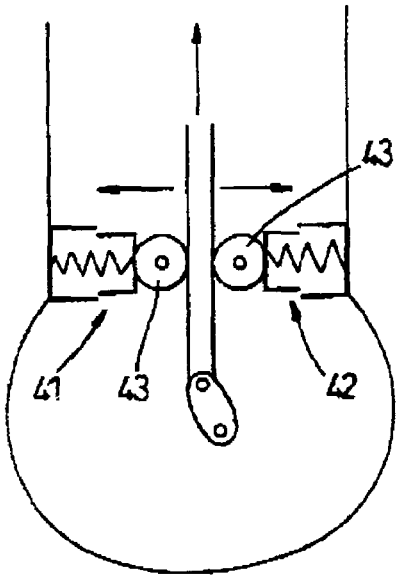
FIG. 4 is a schematic representation of a similar engine to that shown in FIG. 1 having an alternative slide arrangement also shown in plan view in FIG. 4A.
Figure 4A:
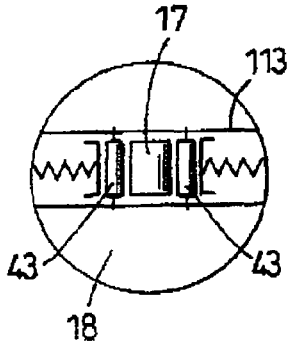

A different sealing arrangement is shown in FIG. 4 and 4A in which the a pair of spring loaded seals 41,42 are located in the aperture 113 in separation plate 18. The connecting rod 17 may bear against the seals, or may contact bearing guides 43 mounted against the seals 41 & 42 respectively. The seals 41,42 reciprocate in the aperture 113 to seal around the moving connecting rod.

Figure 5:
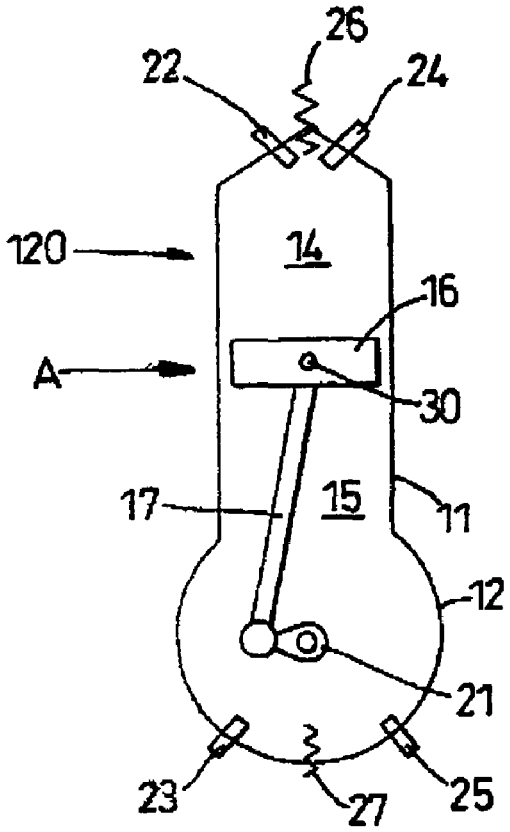
FIG. 5 is a schematic drawing of a cylinder in a second engine configuration also according to the present invention.
Figure 6:
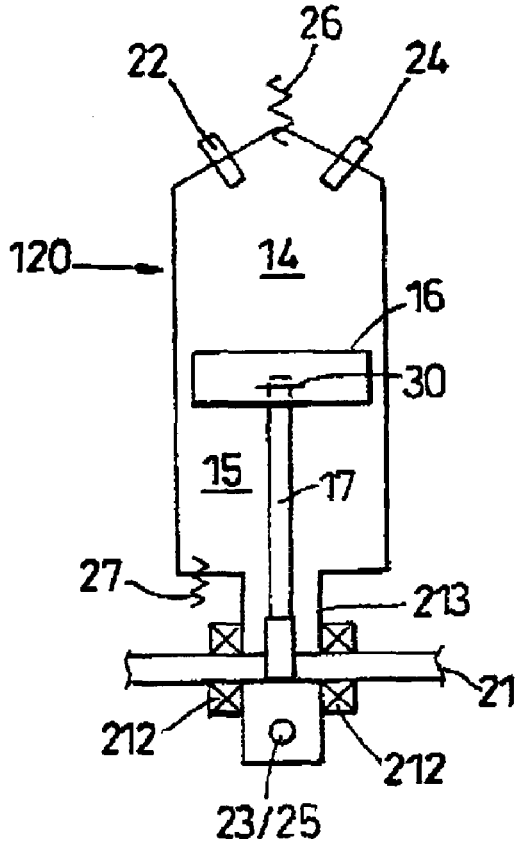
FIG. 6 is view in the direction of arrow A of the cylinder and engine configuration in FIG. 5.

Yet another construction of engine 120 according to the present invention, is shown in FIGS. 5 & 6. This engine is similar to the engine 110 excepting that the lower compression chamber 15 is includes a portion of the sump 12 in which valves 23 & 25 and spark plug 27 are located in the wall thereof. Those components present in FIG. 1 will be given the same reference numbers. Each lower chamber 15 extends only into a portion 213 of the sump with the chamber 15 sealed by bearings/seals 212 around the respective portion of the crankshaft 21. In a preferred condition, the total extended volume of the chamber 15 including the respective portion 213 of the sump equates with the effective working volume of chamber 14.

The engine should preferably be constructed from materials which withstand high temperatures such as ceramics, titanium, etc. and preferably should have shock and/or explosion resistant bearings in the connecting rod arrangement and/or crankshaft.

Lubrication for the above engines may include the use of self lubricating fuels which may comprise added lubricants.

Alternatively, or additionally lubrication may be achieved by high pressure lubrication systems pumping lubricant along internal bores in the crankshaft 21 and rods 17,113 and associated pins and bearings. Oil may be fed to the peripheral surfaces of the piston from the feed to the piston pin and then through pores open to the cylindrical surface of the piston or holes which open under the piston rings.

The engine may use sleeved cylinders having oil porous walls and oil drainage may be provided for the removal of excess oil.

The use of oil porous metals which are pre-impregnated with oil may be possible for short life engine for example but without limitation, racing engines which are stripped between races.

The oil may also acts as a coolant for the engine.

What is claimed is:

1. A four stroke internal combustion engine having at least one cylinder having a crankshaft with a double acting piston dividing the cylinder into two combustion chambers said piston being connected to a respective throw of the crankshaft and being reciprocable within the cylinder to perform a power stroke producing work on the crankshaft while moving towards or away from the crankshaft, the piston being pivotally connected directly to a connecting rod in turn connected directly to a respective throw of the crankshaft, wherein the connecting rod passes sealingly through a separation plate separating the engine sump from the adjacent combustion chamber, the separation plate having an aperture through which the connecting rod passes for accommodating lateral movement of the connecting rod caused by the throw of the crankshaft during rotation thereof, the connecting rod passing through at least one slide member which seals against the rod and is sealingly slidable relative to the separation plate radially or transversely of the cylinder axis.

2. An engine as claimed in claim 1. wherein the slide member comprises seals located in the aperture and which are moveable within the aperture to seal against the rod.

3. An engine as claimed in claim 2 wherein the seals are resiliently biased to seal against the connecting rod.

4. An engine as claimed in claim 3 wherein bearing guides form a contact surface between the seals and the connecting rod.

5. An engine as claimed in claim 1 wherein the slide member slides over the separation plate and is sealed thereto.

6. An engine as claimed in claim 1, wherein the cylinder is located within a cylinder block and the separation plate is sealingly moveable relative to the engine block.

7. An engine as claimed in claim 1, wherein during the Otto cycle engine, one of said chambers is one step In advance of the other chamber of said chambers.

8. An engine as claimed in claim 7, wherein the lower chamber is in advance of the upper chamber.

9. An engine as claimed in claim 7, wherein the upper chamber is in advance of the lower chamber.

10. An engine as claimed in claim 1, being an Otto cycle engine having a plurality of cylinders, wherein during the operational cycle of each cylinder, one of said chambers is one step in advance of the other chamber of said chambers.

11. A four stroke internal combustion engine as claimed in claim 1, having at least one cylinder having a double acting piston dividing the cylinder into two combustion chambers and being reciprocable within the cylinder to perform a power stroke producing work on a crankshaft while moving towards or away from the crankshaft, the piston being pivotally connected directly to a connecting rod in turn connected directly to the crankshaft, wherein the piston and/or cylinder bore are formed from oil porous materials which are pre-impregnated with oil.

12. An engine as claimed in claim 1, wherein the engine includes a plurality of cylinders oriented with respect to each other as is desired.

13. An engine as claimed in claim 2, wherein said one chamber includes a sealed portion of the crankshaft housing.

* * * * *